US005516312A

United States Patent [19]

Reed

[11] Patent Number: 5,516,312

[45] Date of Patent: May 14, 1996

[54] ENGINE SAFETY INTERLOCK

[76] Inventor: Steven L. Reed, 4753 W. Walnut Apt 1085, Garland, Tex. 75042

[21] Appl. No.: 297,313

[22] Filed: Aug. 26, 1994

[51] Int. Cl.[6] ..... B63H 21/22

[52] U.S. Cl. ..... 440/1; 114/270; 440/85; 440/88

[58] Field of Search ..... 440/1, 88, 85; 114/183 R, 270; 340/620

[56] References Cited

U.S. PATENT DOCUMENTS 4,697,535 10/1987 Wileman ..... 440/1

*Primary Examiner*—Jesus D. Sotelo

[57] ABSTRACT

A device for sensing the presence of hull water above an acceptable level in the hull of a boat and communicating to any combination of ignition, starter, aural and/or visible means in such manner as to cause the boats engine to stop running and apprise the boat operator as to the presence of excessive hull water.

5 Claims, 2 Drawing Sheets

ENGINE SAFETY INTERLOCK

BACKGROUND—FIELD OF INVENTION

This invention relates to a device that shuts down an inboard boat engine so as to avoid damage in the event that hull water rises above an acceptable level, specifically to such engines which are used in personal watercraft.

BACKGROUND—DESCRIPTION OF PRIOR ART

Approximately one in twenty personal watercraft sold new each year are damaged by hull water entering the air intake. Manufacturers of personal watercraft loose millions of dollars each year in warranty repairs caused by hull water being drawn into the engine.

Unlike air, water doesn't compress nicely in an engine cylinder. When water is drawn into an engine, the results are devastating. Pistons and rods are shattered. The crankshaft is bent. Main bearings are often crushed and imbedded into their hardened steel tracks.

Heretofore, the personal watercraft industry has had no better solution than to simply repair the damage after the fact. My invention will solve this problem by stopping the engine when the hull water rises above an acceptable level. For example, when the drain plug is left out or if a hose breaks in the engine cooling system. My search, under "water, measuring depth of, liquid level or depth immersible electrode type" (ref class 73 subclass 290R), revealed that numerous types of water sensors have been proposed. The only patent that I found which included a boat was U.S. Pat. No. 3,296,863 (1955) for a "Ship Drift Gage". It had nothing to do with turning the engine off. The patent predated that of the "Weight Steered Water Sled" U.S. Pat. No. 3,433,201 which to my knowledge is the earliest known art (1967) of any personal watercraft. The "Weight Steered Watersled" had an open hull and an outboard motor. It predates the modem personal watercraft with an inboard motor and a covered or enclosed hull.

OBJECTS AND ADVANTAGES

Accordingly, several objects and advantages of my invention are:

(a) To provide a device-that tells the user when the drain plug has been left open.

(b) To provide a way to warn the user when an engine cooling hose has burst and is filling the hull with water.

(c) To provide low cost yet extremely reliable protection against expensive engine damage.

(d) To provide an effective means of greatly reducing or eliminating the annual cost, to watercraft manufacturers, of expensive warranty repair due to engine water damage.

DESCRIPTION OF DRAWINGS

The circuit schematic diagram is reduced into small groups of components that work together to produce the function of each assembly. The combined assemblies work together to produce the function of my invention.

DESCRIPTION—FIGS. 1 TO 5

Figure 1:
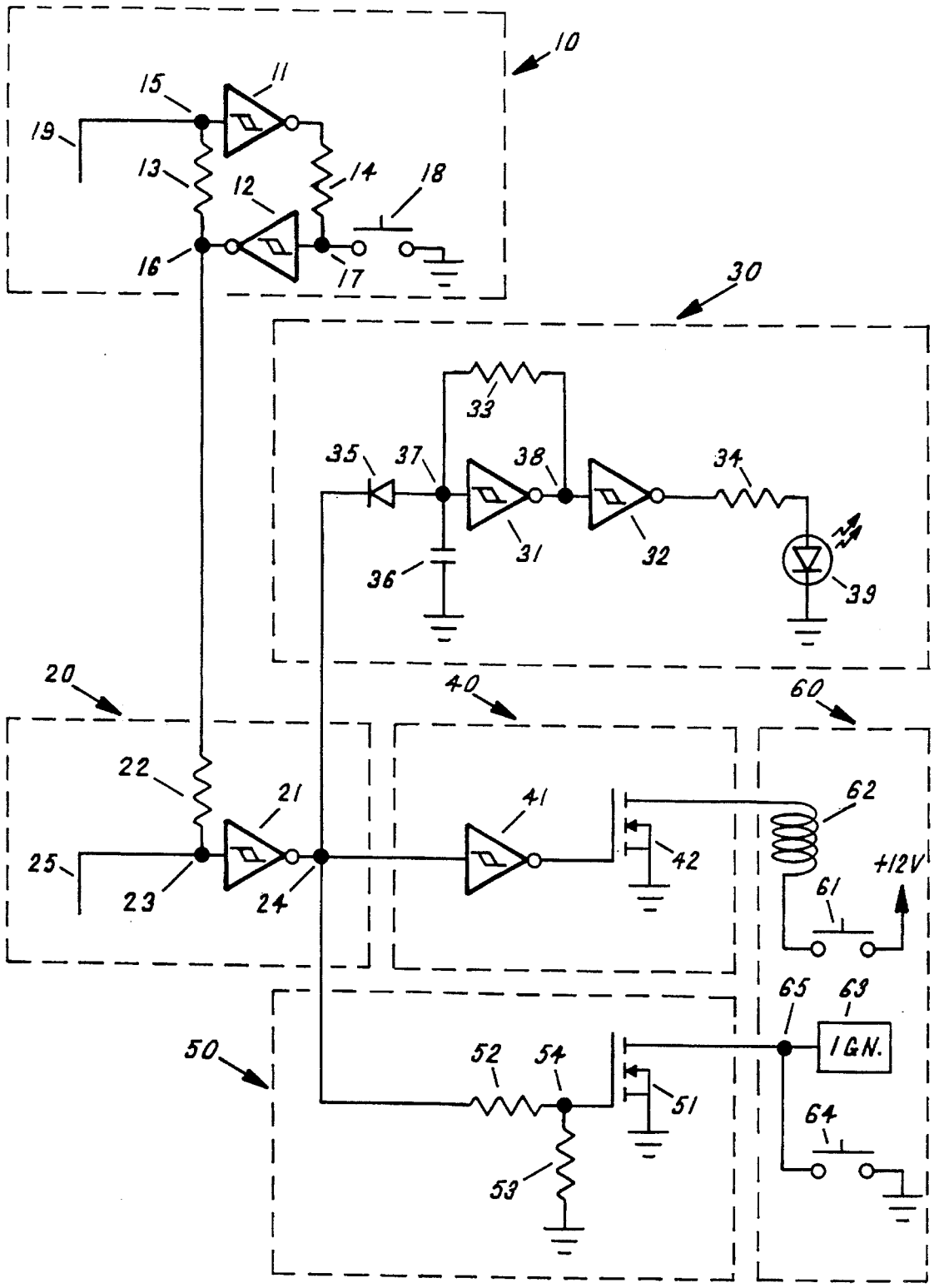
FIG. 1 shows the overall circuit diagram.

A typical embodiment of my invention is illustrated in FIG. 1. The device has a sensor probe or probes 19 and 25. The probe is made of a piece of electrical wire which is long enough to reach from inside the electrical box on the boat where the device is mounted, to the place in the hull of the boat where the hull water is to be sensed. The end of the wire which terminates out in the hull is exposed so as to be able to come into physical electrical contact with the water in the hull. To avoid the formation of an electrically conductive surface film of water on the insulation, the insulation of the wire is made of a suitable type of material on which a conductive film of water will not form for example Teflon-brand PTFE; Teflon is a trademark of E.I. duPont de Nemours & co., Wilmington, Del. There are a number of other insulating materials which will also work as well.

The end of the probe wire which terminates in the electrical box is electrically connected to node 15 which also connects to resistor 13 and input of inverter 11. The output of inverter 11 connects to resistor 14. The other end of resistor 14 connects to node 17 which also connects to latching sensor reset switch 18 and the input of inverter 12. The output of inverter 12 connects to node 16 which connects to the remaining end of resistor 13 and to resistor 22 in non-latching sensor circuit assembly 20.

Assembly 20 describes a non-latching sensor. The probe 25 of this sensor being of the type described in the above text. The end of the probe wire which terminates in the electrical box is electrically connected to node 23 which also connects to the remaining end of resistor 22 and the input of inverter 21 the output of inverter 21 connects to node 24 which connects to cathode of diode 35 in assembly 30. The input of inverter 41 in assembly 40, and the gate of transistor 51 in assembly 50.

Assembly 30 describes the light controller circuit assembly in which anode of diode 35 connects to node 37. Node 37 connects to resistor 33, inverter 31, and capacitor 36. The remaining end of capacitor 36 connects to common. The output of inverter 31 connects to node 38 which also connects to the remaining end of resistor 33 and the input of inverter 32. The output of inverter 32 connects to resistor 34. The remaining end of resistor 34 connects to anode of LED indicator 39. The cathode of LED indicator 39 connects to common.

Assembly 40 describes the starter actuator controller circuit assembly. The input of inverter 41 is connected to node 24. The output of inverter 41 is connected to the gate of transistor 42. The source of transistor 42 is connected to common. The drain of transistor 42 is connected to one end of the starter relay actuator 62. The remaining end of the starter relay actuator 62 connects to one side of the starter switch 61 The remaining side of the starter switch 61 connects to +12 volts through the electrical system of the boat.

Assembly 50 describes the engine ignition controller circuit assembly wherein the gate of transistor 51 is connected to node 24 through resistors 52 and 53. The source of transistor 51 is connected to common. The drain of transistor 51 is connected to node 65. Node 65 connects to the ignition kill switch 64 and to the ignition control module 63.

Figure 2:
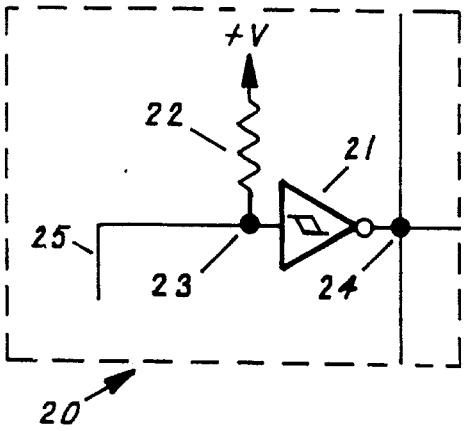
FIG. 2 shows a detail of assembly 20, non-latching sensor as it may be made to work without block 10 latching sensor.

FIG. 2 describes a different embodiment of the non latching sensor circuit assembly in which the latching sensor circuit assembly is not used. It is connected as described in FIG. 1 with one exception. The end of resistor 22 which used to connect to node 16 as shown in FIG. 1, is now connected to positive as shown in FIG. 2

Figure 3:
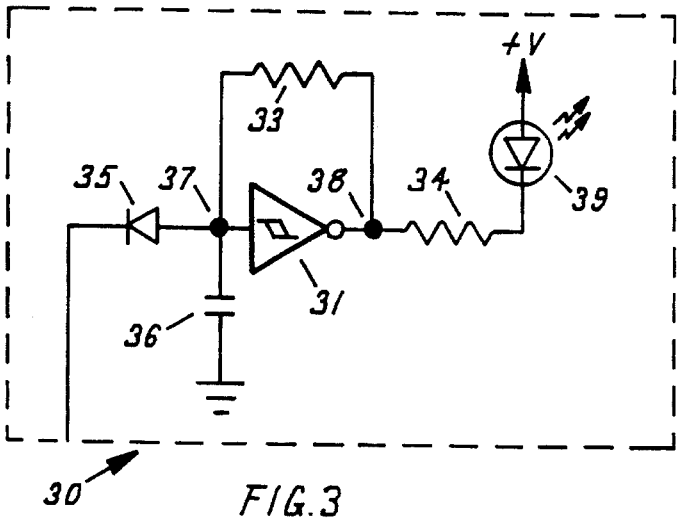
FIG. 3 shows a detail of block 30 as it may be made to work with fewer components.

FIG. 3 describes a different embodiment of the light control circuit assembly in which inverter 32 is not used. It is connected as described above in FIG. 1 with three exceptions. Node 38 connects to resistor 34. The remaining end of resistor 34 connects to cathode of LED indicator 39. The anode of LED indicator 39 connects to +12 v.

Figure 4:
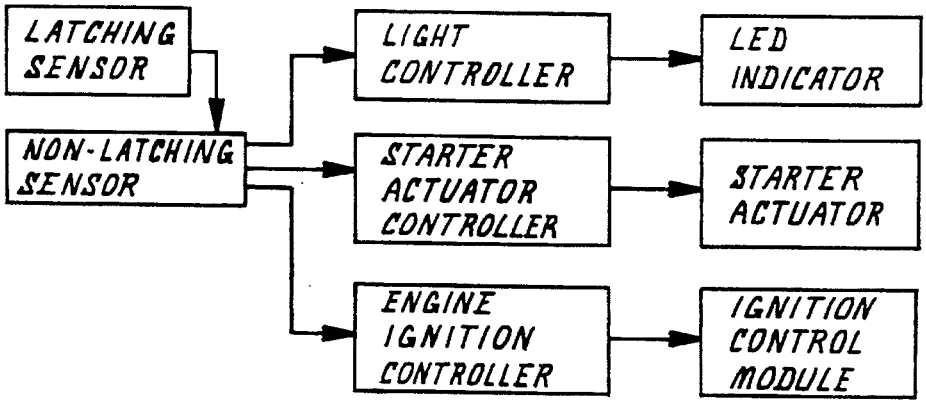
FIG. 4 Shows an overall block diagram of my invention.

FIG. 4 is a block diagram of my invention.

Input from sensor 19 goes to latching sensor circuit assembly 10. Input from sensor 25 goes to non-latching sensor circuit assembly 20. Latching sensor circuit assembly 10 goes to non-latching sensor circuit assembly 20. Non-latching sensor circuit assembly 10 goes to light controller circuit assembly 30. Starter actuator controller circuit assembly 40, and engine ignition controller circuit assembly 50. Light controller circuit assembly 30 goes to LED indicator 39. Starter actuator controller circuit assembly 40 goes to starter relay actuator 62. Engine ignition controller circuit assembly 50 goes to output to ignition controller module 63.

Figure 5:
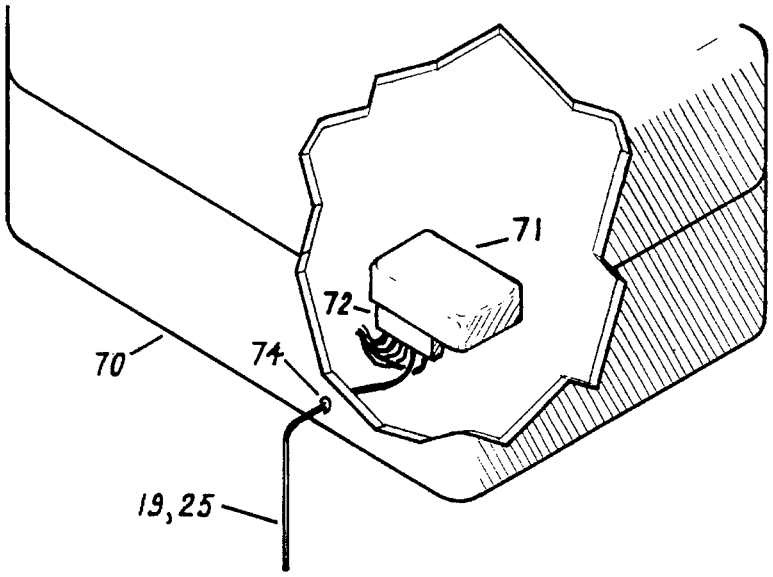
FIG. 5 Shows a pictorial drawing of my invention as installed in the hull of a boat.

FIG. 5 is a pictorial drawing describing my invention as installed. Sensor 19 and/or 25 pass through a hole 74 in the electrical box 70 to the electrical mounting connector 72 which is mounted to the inside of the electrical box 70. The engine safety interlock embodied as an electronic module 71 plugs into the mounting connector 72. The water sensor probe(s) 19, 25 connect to the module 71 through the electrical mounting connector 72.

OPERATION—FIGS. 1 TO 5

The engine safety interlock is mounted in the electrical box of a boat as shown in FIG. 5. When the water sensor probe is sensing the presence of no water, node 23 is held above 8 volts through resistor 22 (FIG. 2). This causes the input of inverter 21 to be above 8 volts, causing the output of inverter 21 to remain at a low potential voltage. This causes node 24, the cathode of diode 35, the input of inverter 41, and the gate of transistor 51 to be held at 0 volts (FIG. 1). When cathode of diode 35 is held at 0 volts it conducts. Node 37 and input of inverter 31 are held at 0 volts, this causes the output of inverter 31, node 38, and input of inverter 32 to be held above 8 volts. This causes output of inverter 32 to drop to 0 volts and keeps the LED indicator 39 from emitting light, thereby indicating an acceptable level of hull water.

When node 24 is pulled below 4 volts input of inverter 41 is also below 4 volts. This causes output of inverter 41 to go to a high enough voltage to turn on the gate of transistor 42. Resistors may be added to the gate of transistor 42 to provide a voltage drop and lower the gate voltage if this seems necessary.

When the gate of transistor 42 turns on, transistor 42 is allowed to conduct current in order to provide a ground path for the starter relay actuator 62. This allows the engine to start when the starter button 61 is pushed. A diode can be added between +12 volts and the drain of transistor 42 if this seems desirable.

When node 24 is held at 0 volts the gate of transistor 51 is held at 0 volts which keeps transistor 51 in a non-conductive state. This does not allow it to pull the voltage on the control wire (node 65) to 0 volts. Thereby allowing the engine to run.

Resistor 22 holds node 23 and input of inverter 21 above 8 volts (FIG. 2). When hull water rises above an acceptable level, it comes into electrical contact with the tip of the water sensor probe 25. This pulls the voltage on node 23 toward 0 volts by conducting a microcurrent to ground through the probe. The probe current is typically less than 15 microamps. This pulls the voltage on node 23, and the input of inverter 21 below 4 volts. This causes the output of inverter 21 to rise to +12 volts. This pulls node 24, the cathode of diode 35, and the input of inverter 41 to +12 volts. The gate voltage of transistor 51 is brought up above its turn on threshold.

When the cathode of diode 35 is pulled up to + 12 volts, diode 35 becomes open (does not conduct). This allows resistor 33 to pull node 37 toward a more positive voltage as it charges capacitor 36. When the voltage across capacitor 36 rises above about 8 volts inverter 31 will change state. Its output will change to 0 volts. Capacitor 36 will now begin to discharge through resistor 33. When the voltage on capacitor 36 becomes less than about 4 volts the output of inverter 31 will change state again returning to +12 volts. The output of inverter 31 will cycle positive and negative about 2 to 3 cycles per second causing inverter 32 to oscillate along with it. This will cause LED indicator 39 to flash off and on. Thus indicating the presence of an unacceptable level of hull water to the boat operator. The oscillation of inverter 31 will continue until node 24 is returned to less than 4 volts, disabling the oscillator.

When the presence of water is sensed node 24 is at 12 volts. The input of inverter 41 is raised above 8 volts. Its output changes to 0 volts. The gate of transistor 42 is caused to go below its turn on threshold voltage. Transistor 42 becomes open (non-conducting) thereby disabling the starter relay actuator 62.

When the presence of water is sensed node 24 becomes +12 volts. The gate of transistor 51 is brought above its threshold voltage. Transistor 51 is made to close (conducting) pulling current from node 65. This causes the control wire on the ignition control module 63 to go to 0 volts. This disables the ignition, and the engine stops.

In the event that it becomes necessary for the engine to remain off and unstartable when the water sensor probe momentarily senses water, I have designed latching sensor circuit assembly 10 (FIG. 1). When the water sensor probe 19 touches hull water it pulls the input of inverter 11 to less than 4 volts. The output of inverter 11 changes state to +12 volts. This pulls the input of inverter 12 up to above +8 volts. This causes its output to drop to 0 volts, connecting 0 volts onto the input of inverter 11 through resistor 13. This also pulls node 23 to 0 volts through resistor 22.

This causes my invention to behave as if hull water is above an acceptable level. This condition will remain until the latching sensor reset switch 18 is momentarily closed. Momentarily closing the switch 18, resets the latching sensor circuit assembly 10. The latching sensor circuit assembly 10 will also work without the non-latching sensor circuit assembly 20. This is accomplished by removing resistor 22, sensor 25, node 23, and inverter 21 from the circuit and connecting node 17 directly to node 24.

FIG. 3 describes a method for making the light controller circuit assembly 30 with only one inverter instead of two. This is accomplished by removing inverter 32 from light controller circuit assembly 30 as described in FIG. 1, connecting one end of resistor 34 to node 38, connecting the cathode of LED indicator 39 to the remaining end of resistor 34, and connecting the anode of LED indicator 39 to +12 volts.

The circuits of FIG. 1 assembly 30 and FIG. 3 assembly 30 both work equally as well when the capacitor 36 ground connection is removed and connected to +12 volts instead. The inverters described in this embodiment, and shown in FIGS. 1, 2, and 3 are of a cmos Schmitt Trigger type. Many personal watercraft are made without an ignition switch. It may be necessary for this device to remain connected to the battery voltage for extended periods of time without the engine running and charging the battery. In its quiescent state (no water in hull, LED indicator 10 not flashing) it typically pulls 20 microamps. A lead acid battery of the type normally used for this application, will last a very long time at this level of drain.

Schmitt trigger inverters are used throughout this embodiment. They provide hysteresis, which is desirable for rejecting unwanted spurious signals such as ignition noise. Schmitt triggers also provide a simple means of building an oscillator circuit as described in FIG. 1 assembly 30 because the voltage on the input must swing back and forth between ⅓ and ⅔ Vdd (4 volts and 8 volts respectively when Vdd= +12 volts).

Power and ground connections to the inverters, necessary power filtering and conditioning are assumed to be obvious. The negative battery terminal connects to the hull water through the engine block. Thus the reader can see that my invention provides a safe, reliable, efficient, practical, and workable device to protect an engine from expensive water damage. Shutting the engine off seconds before it would have been destroyed by water entering the air intake. When the water sensor is set lower in the hull it can be used as a means of early warning to the boat operator that the drain plug has been left out or the engine cooling system has broken a hose.

While my above description contains many specificity's, these should not be construed as limitations on the scope of the invention, but rather as an exemplification of one preferred embodiment thereof, for example it can be embodied as a mechanical float which actuates micro switches. This device could also be embodied using an optical means of sending light down an optic fiber cable or glass or plastic rod when water contacts the end of the rod, some of the light would go into the water.

The change of the light reflecting back into an optical sensor could trigger the device to indicate an alarm and shut down the engine. Two sensing devices could be used, one lower in the hull as an early warning that only sounds a signal or lights an indicator, and one higher in the hull to shut down the engine should the signal be ignored.

Accordingly, the scope of the invention should be determined not by the embodiments illustrated, but by the appended claims and their legal equivalents.

I claim:

1. A device for stopping the engine of a boat from aspirating hull water comprising:

(a) a sensing means for detecting the presence of said hull water above an acceptable level (b) an electrical means for stopping said engine when said sensing means detects said hull water above said acceptable level in such manner as to keep said engine from drawing said hull water into the air intake of said engine (c) an electrical means for disconnecting the starter relay actuator of said engine when said sensing means detects said hull water above said acceptable level in such manner that engaging the starter actuator will not allow starter to turn said engine thereby preventing said starter from becoming engaged until said hull water returns to within said acceptable level.

2. The device of claim 1, further including a signaling means connected to the output of said sensing means in such manner that the operator of said boat will be apprised as to the cause of the loss of power to said engine.

3. A device for stopping the aspiration of the hull water into the engine of a personal watercraft comprising:

(a) a sensing means for detecting the presence of said hull water in the hull of said personal watercraft above an acceptable level (b) an electrical means for stopping said engine when said sensing means detects said hull water above said acceptable level in such manner as to keep said engine from drawing said hull water into the air intake of said engine (c) an electrical means of disabling the starter of said engine from being engaged when said sensing means detects said hull water above said acceptable level in such manner as to keep said engine from drawing said hull water into said engine until such time that said hull water returns to within said acceptable level.

4. The device of claim 3, further including a signaling means connected to the output of said sensing means in such manner that the operator of said personal watercraft will be apprised as to the cause of the loss of power to said engine.

5. A device for stopping the aspiration of hull water into the engine of a boat comprising:

(a) a sensing means for detecting the presence of said hull water in the hull of said boat above an acceptable level (b) an electrical means for stopping said engine when said sensing means detects said hull water above said acceptable level in such manner as to keep said enginef from drawing said hull water into the air intake of said engine (c) an electrical means of disabling the starter of said engine from being engaged when said sensing means detects said hull water above said acceptaable level in such manner as to keep said engine from drawing water into said air intake until such time that said hull water returns to within said acceptable level at which time said starter will be automatically re-enabled to work when starter actuator is engaged (d) a signaling means connected to the output of said sensing means in such manner that the operator of said boat will be apprised as to the cause of the loss of power to said engine.

* * * * *